US011066216B2

(12) United States Patent
Cheng

(10) Patent No.: US 11,066,216 B2
(45) Date of Patent: Jul. 20, 2021

(54) FLIP LID AND CONTAINER INCLUDING THE SAME

(71) Applicant: Zhejiang Haoda Science & Technology Co., Ltd, Jinhua (CN)

(72) Inventor: Haojun Cheng, Jinhua (CN)

(73) Assignee: ZHEJIANG HAODA SCIENCE & TECHNOLOGY CO., LTD, Jinhua (CN)

( * ) Notice: Subject to any disclaimer, the term of this patent is extended or adjusted under 35 U.S.C. 154(b) by 393 days.

(21) Appl. No.: 16/188,249

(22) Filed: Nov. 12, 2018

(65) Prior Publication Data

US 2020/0095030 A1 Mar. 26, 2020

(30) Foreign Application Priority Data

Sep. 21, 2018 (CN) ..... 201811107619.7
Sep. 21, 2018 (CN) ..... 201821554907.2

(51) Int. Cl.
*B65D 47/08* (2006.01)
*B65D 53/02* (2006.01)

(52) U.S. Cl.
CPC ..... *B65D 47/0861* (2013.01); *B65D 53/02* (2013.01)

(58) Field of Classification Search
CPC .... B65D 47/0861; B65D 53/02; B65D 47/08; B65D 43/16; B65D 43/26; B65D 47/249; B65D 47/0857; B65D 43/164; B65D 43/163
USPC ..... 220/827, 254.3, 254.5, 830, 711
See application file for complete search history.

(56) References Cited

U.S. PATENT DOCUMENTS 7,011,227 B2 * 3/2006 Ward ..... B65D 47/0857 220/254.3
7,918,359 B2 * 4/2011 Paris ..... B65D 17/506 220/254.3
2006/0043091 A1 * 3/2006 Pinelli ..... A47G 19/2272 220/254.3
2013/0140309 A1 * 6/2013 George ..... B65D 43/02 220/254.1
2013/0320012 A1 * 12/2013 Lucas ..... B65D 43/265 220/254.1
2014/0263476 A1 * 9/2014 Blain ..... A47G 19/2272 222/545
2015/0164255 A1 * 6/2015 Coon ..... A47G 19/2272 220/254.3
2016/0264312 A1 * 9/2016 Choltco-Devlin ..... B65D 47/0895
2017/0273484 A1 * 9/2017 Spivey ..... B65D 47/0833
2018/0244441 A1 * 8/2018 Wodka ..... B65D 47/245

* cited by examiner

*Primary Examiner* — J. Gregory Pickett
*Assistant Examiner* — Tia Cox

(57) ABSTRACT

A flip lid including a lid body is provided. The lid body can include a outlet through the lid body. A flap is rotatably connected to one side of the lid body. A rotating element is rotatably connected to the other side of the lid body. A resetting member urges the rotating element to a sealing position to seal against the outlet. An actuating member is disposed on a side of the rotating element facing the outlet. The flap includes an actuating protrusion. During a rotation of the flap, the actuating protrusion is in contact with the actuating member to cause the rotating element to rotate away from the sealing position to an unsealing position to break the seal with the outlet.

11 Claims, 8 Drawing Sheets

FLIP LID AND CONTAINER INCLUDING THE SAME

CROSS-REFERENCE TO RELATED APPLICATIONS

This application claims all benefits accruing under 35 U.S.C. § 119 from China Patent Application Nos. 201821554907.2, filed on Sep. 21, 2018, and 201811107619.7, filed on Sep. 21, 2018, both in the State Intellectual Property Office of China, the content of which is hereby incorporated by reference.

FIELD OF THE DISCLOSURE

The present disclosure relates to lids and containers, and more particularly, to flip lids and containers including the same.

BACKGROUND OF THE DISCLOSURE

A container such as a bottle or a coffee cup includes a lid and a container body. The lid is often closely connected to the container body by a threaded engagement or a buckle. When accessing contents in the container, it is necessary to open the entire lid or a part of the lid. The lid can be opened by unscrewing the lid from the container body or opening a part of the lid to allow the contents in the container body to flow out the opening. The process of unscrewing the lid from the container body is an inconvenient operation, and more and more lids are separately provided with an opening and closing structure.

SUMMARY OF THE DISCLOSURE

An aspect of the present disclosure includes a flip lid including a lid body. The lid body can include an outlet through the lid body. A flap can be rotatably connected to one side of the lid body. A rotating element can be rotatably connected to another side of the lid body. The rotating element can be movable between a sealing position and an unsealing position. A resetting member can apply a force to the rotating element towards the sealing position. The rotating element covers the outlet in the sealing position. A sealing portion of the rotating element can form a seal with the outlet in the sealing position. The sealing portion can be a sealing ring. An actuating member can be disposed on a side of the rotating element facing the outlet. The flap can include an actuating protrusion. During a rotation of the flap, the actuating protrusion can push the actuating member away from the sealing position to an unsealing position, in which the seal between the rotating element and the outlet is broken.

The actuating member can include an opening section protruding toward the outlet and a locking groove away from the outlet. When the actuating protrusion contacts the opening section, the rotating element can rotate to open the outlet. When the actuating protrusion enters the locking groove, the flap can be locked.

The flap can include a locking protrusion. After the flap rotates until the actuating protrusion is out of the locking groove, the locking protrusion can insert into the locking grooves.

When the flap is at a closed position, the actuating protrusion can abut against an end of the opening section.

The lid body can include a second fastening edge corresponding to a fully open position of the flap, and when the locking protrusion inserts into the locking groove, the flap can abut against the second fastening edge.

The lid body can include a concave groove, and the resetting member can be a torsion spring. One end of the torsion spring can be fastened to the rotating element, and the other end of the torsion spring can be received in the concave groove.

The actuating member can be integrally formed with the rotating element.

The rotating element can include a sealing ring surrounding the outlet.

A sealing flange can be formed on a side of the outlet facing the rotating element. The sealing ring can be pressed against the sealing flange.

The flap can be rotatably connected to the lid body through a pivot shaft. One end of the flap can extend beyond an edge of the lid body to form a driving end. The actuating protrusion and the driving end can be respectively located at two sides of the pivoting shaft.

The lid body can further include a first fastening edge corresponding to the closed position of the flap. The first fastening edge includes a snap groove and the flap includes a snap projection couple to the snap groove when the flap is at the closed position of the flap.

A container with the flip lid is further provided. The container can include the flip lid including a lid body. The lid body can include a outlet through the lid body. A flap can be rotatably connected to one side of the lid body. A rotating element can be rotatably connected to the other side of the lid body. The rotating element can be at a sealing position to make the outlet seal by a resetting member. An actuating member can be disposed on a side of the rotating element facing the outlet. The flap can include an actuating protrusion. During a rotation of the flap, the actuating protrusion can be in contact with the actuating member away from? a rotating shaft of the rotating element, resulting in pushing the rotating element to rotate to an unsealing position to unseal the outlet.

The flip lid and the container have the following advantages:

The rotating element can be at the sealing position so that the outlet can be sealed by the resetting member. When opening the flap, the actuating protrusion of the flap is in contact with the actuating member of the rotating element, resulting in pushing the rotating element to rotate against the force of the resetting member and causing the outlet to open. Thus, a linkage relationship between the rotating element and the flap can be established. When cleaning the cup lid, the rotating element and the flap can be rotated independently, to make washing more convenient.

BRIEF DESCRIPTION OF THE DRAWINGS

References are made to the accompanying drawing(s) to better illustrate the present disclosure. However, the accompanying drawings represents only some embodiments of the disclosure, and are not meant to be exhaustive.

DETAILED DESCRIPTION OF THE DISCLOSURE

The following description will render a clear and complete description of the present disclosure in combination with the embodiments and accompanying drawings. Obviously, the embodiments described herein are only part but not all embodiments of the disclosure. Any other embodiments obtained by those of skill in the art without making inventive efforts shall all be covered within the protection of the disclosure.

Figure 8:
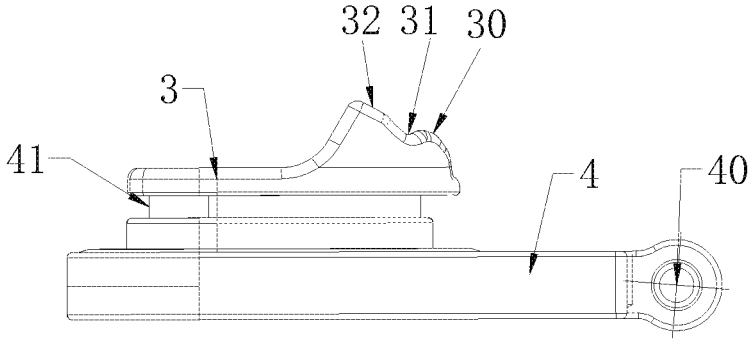
FIG. 8 is a side view of an assembly of the rotating element and the actuating member of FIG. 1.
Figure 9:
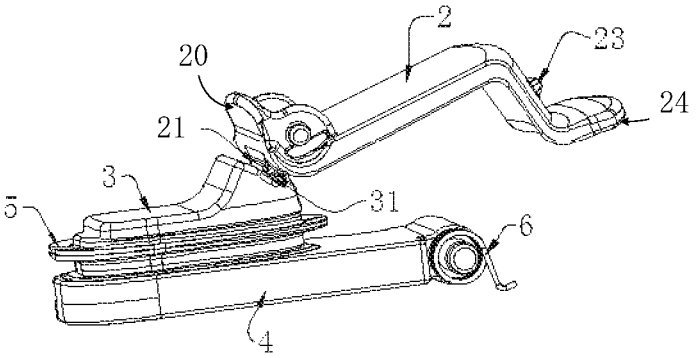
FIG. 9 is a perspective view of an assembly of the flap, the rotating element, the actuating member, and the resetting member in another embodiment.
Figure 10:
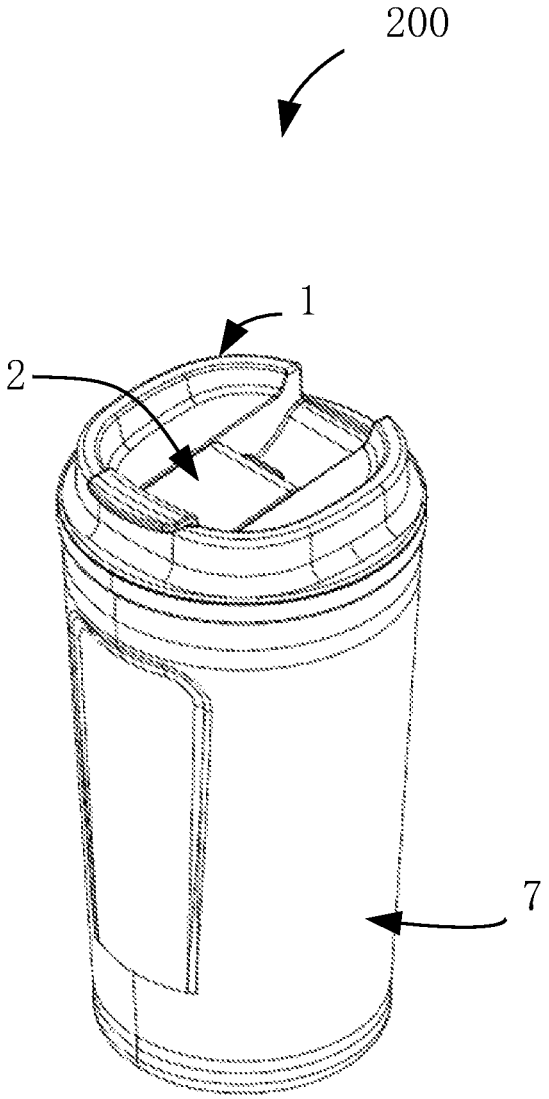
FIGS. 10 to 12 are perspective views of containers including the flap lid.
Figure 11:
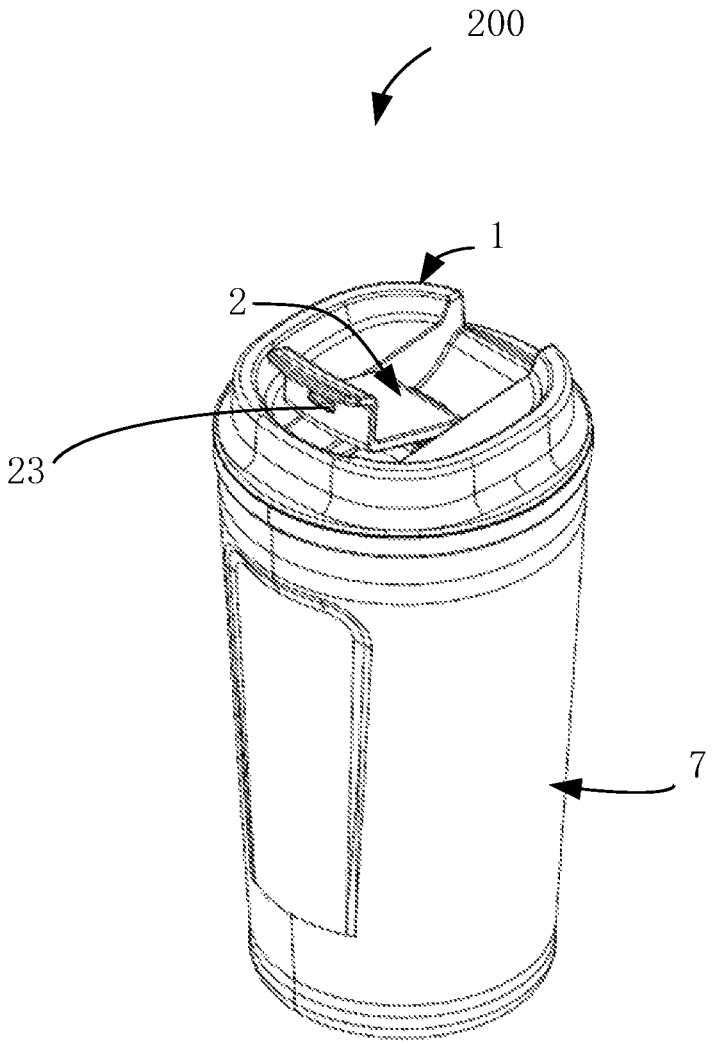
Figure 12:
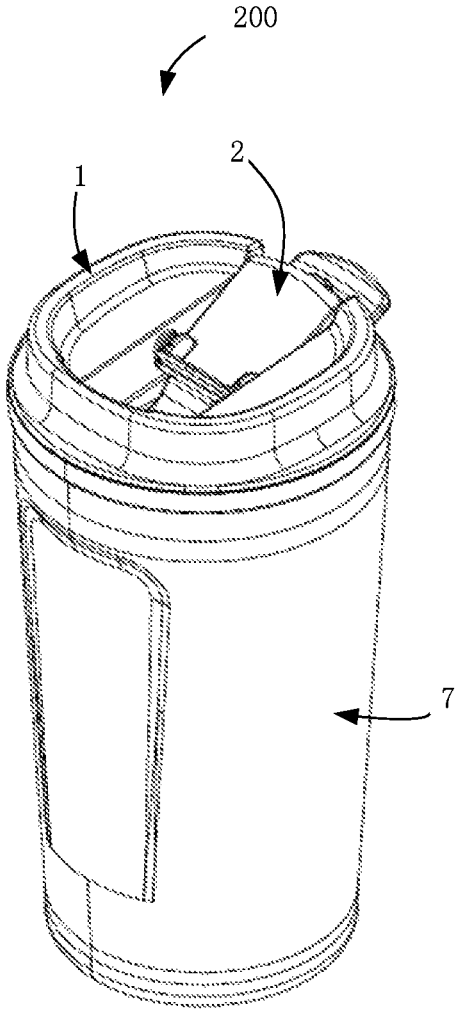

Referring to FIG. 1 to FIG. 9, a flip lid 100 including a lid body 1 is provided. The lid body 1 includes an outlet 10 extending through the lid body 1. FIGS. 10 to 12 shows a container 200 comprising the flip lid 100 coupled to a container body 7 (see FIGS. 10 to 12) such as a bottle or a coffee cup. Contents in a container 200 can flow out through the outlet 10 when the flip lid 100 is open. In some embodiments, the flip lid 100 can include a threaded portion 18 so that the flip lid 100 can engage a threaded portion (not shown) of the container body 7. It is understood that the flip lid 100 may also cover the container body 7 in a manner of a snap or other connection instead of a threaded engagement.

A flap 2 can be movably or rotatably coupled to an outer side of the lid body 1, and a rotating element 4 can be movably or rotatably coupled to an inner side of the lid body 1. The inner side of the lid body 1 can be defined as a side facing an interior cavity of the container body 7, and the outer side of the lid body 1 can be defined as a side facing away from or outside the interior cavity of the container body 7. Therefore, the rotating element 4 can be rotatably connected to the inner side of the lid body 1 and within the interior cavity of the container body 7, and the flap 2 can be rotatably connected to the outer side of the lid body 1 away from the interior cavity of the container body 7. Thus, a user operates the flap 2 to open or close the flap lid 100.

Figure 4:
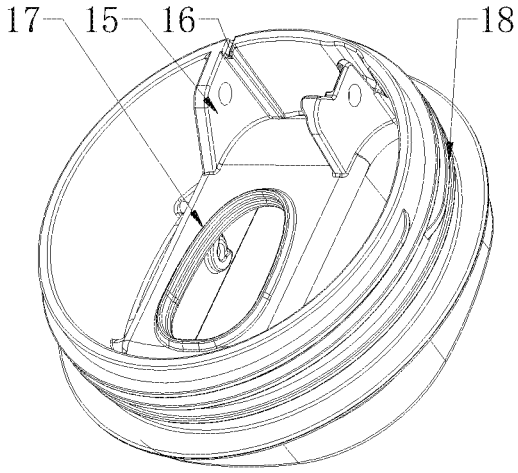
FIG. 4 is a perspective view of the lid body of the flap lid of FIG. 3 at another angle.
Figure 5:
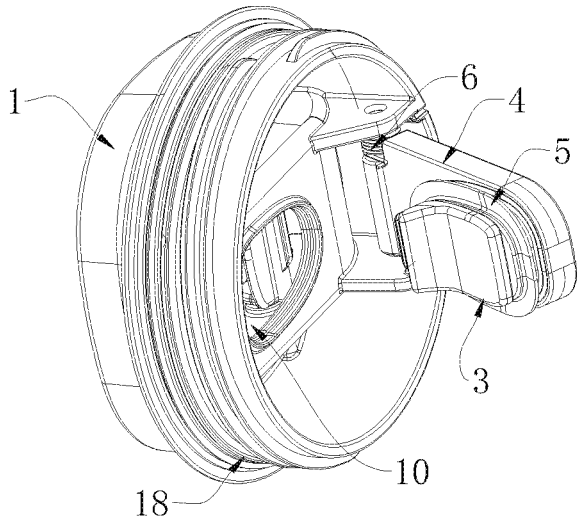
FIG. 5 is a perspective view of the lid body and the rotating element of FIG. 2.
Figure 7:
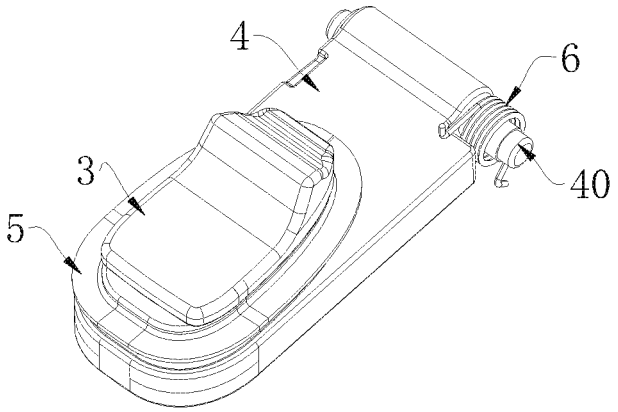
FIG. 7 is a perspective view of an assembly of the rotating element, the actuating member, and the resetting member of FIG. 1.

Referring to FIG. 4 and FIG. 7, the rotating element 4 can include a rotating shaft 40 extending from opposite sides of the rotating element 4. The rotating shaft 40 can be coupled to a rotating pivot joint 15 disposed on the inner side of the lid body 1. Therefore, the rotating element 4 can be rotatably connected to the lid body 1 by rotating about the rotating pivot joint 15. The rotating element 4 can be rotatable between a sealing position and an unsealing position.

The rotating element 4 can further include a sealing portion or sealing ring 5 surrounding the outlet 10 to form a seal with the outlet 10. The sealing ring 5 can be directly elastically fixed to an outer periphery of a portion of the rotating element 4 or the rotating element 4 can have a sealing portion. Alternatively, the rotating element 4 can include a sealing groove 41 (see FIG. 8), and the sealing ring 5 can be fixed in the sealing groove 41. A sealing flange 17 can be formed along the outlet 10 facing the rotating element 4. When the rotating element 4 covers the outlet 10 under the force of a resetting member 6, the sealing ring 5 can press on the sealing flange 17 to seal the outlet 10, as discussed below.

When the rotating element 4 is at a sealing position, the rotating element 4 covers the outlet 10 under the force of the resetting member 6. Said differently, the resetting member maintains a sealing state of the outlet 10 by the rotating element 4. For example, a user must apply a pressure against the rotating element 4 greater than the force of the resetting member to push the rotating element 4 from a sealing position towards an unsealing position to open the outlet 10. After the user releases the pressure, the resetting member 6 can move the rotating element 4 back to the sealing position.

Referring to FIG. 7, in some embodiments, the resetting member 6 can be a torsion spring, and torsion spring force of the torsion spring can force the rotating element 4 at the sealing position to close the outlet 10. A concave groove 16 can be disposed on the lid body 1, and a concave groove can be disposed on the rotating element 4. Each concave groove can receive an end of the torsion spring to secure the two ends of the torsion spring.

Figure 1:
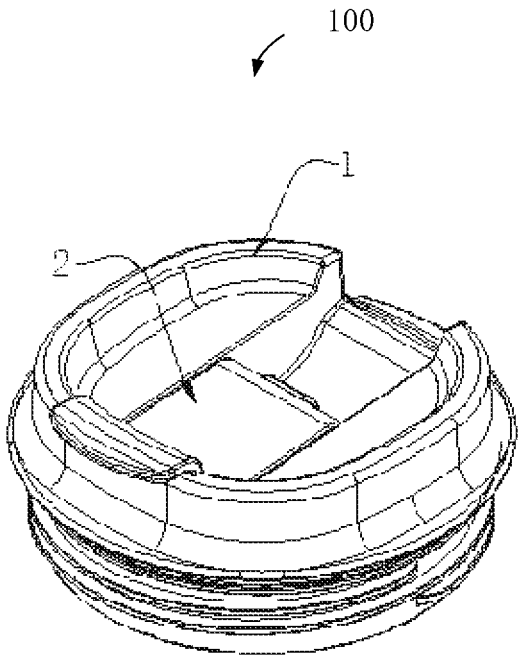
FIG. 1 is a perspective view of a flip lid in one embodiment, wherein the flap is at a closed position.
Figure 2:
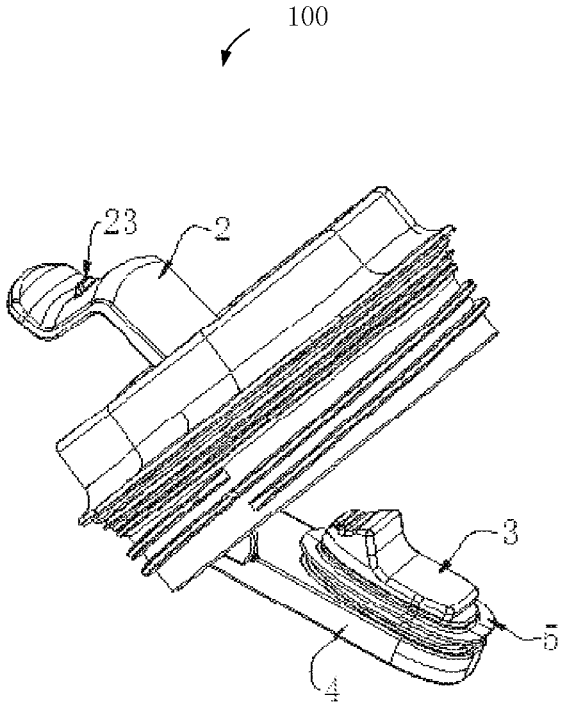
FIG. 2 is another perspective view of the flip lid of FIG. 1, wherein the flip lid is being cleaned.
Figure 3:
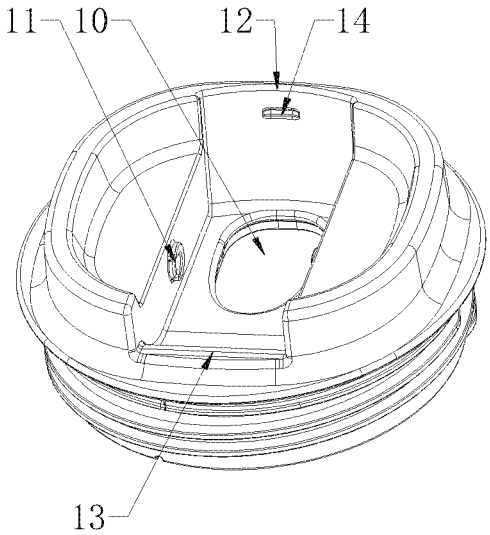
FIG. 3 is another perspective view of the lid body of the flip lid of FIG. 2.
Figure 6:
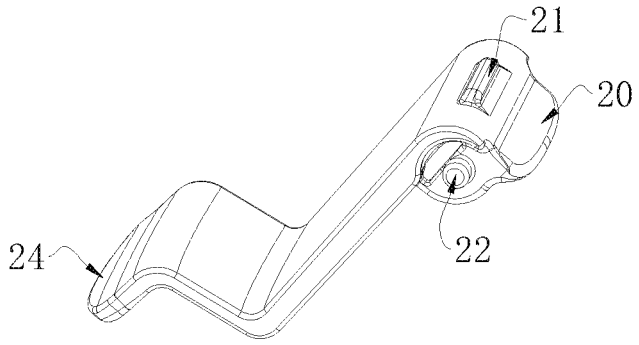
FIG. 6 is a perspective view of the flap of the flap lid of FIG. 1.

Referring to FIG. 3, a flap pivot joint 11 can be disposed on the lid body 1. As shown, the flap pivot joint 11 are disposed on opposite walls of a channel on the outer side of the lid body 1 to pivotally connect with the flap 2. Referring to FIG. 6, the flap 2 is rotatably connected to the lid body through a pivot shaft 22. The pivot shaft 22 of the flap 2 is rotatably coupled to the flap pivot joint 11. In one embodiment, one end of the flap 2 can extend beyond edge of the lip body 1 to form a drive end 24, and an actuating protrusion 20 can be located at the other end of the flap 2.

Referring to FIG. 10, FIG. 11, and FIG. 12, in some embodiments, the rotation of the flap 2 can have a closed position and an open position, and a fully open position, respectively. Referring to FIG. 3, the lid body 1 is provided with a first fastening edge 12 and a second fastening edge 13. A fastening groove 14 can be located on the first fastening edge 12. A fastening protrusion 23 can be respectively located on the flap 2 coupling the fastening groove 14. When the flap 2 is at the closed position, the drive end 24 of the flap 2 contacts the first fastening edge 12 of the lid body and the fastening protrusion 23 is received in the fastening groove 14 thereby fixing the flap 2 in the closed position. Alternatively, the position of the fastening protrusion 23 and the fastening groove 14 can be interchanged. When the flap 2 rotates to the fully open position, the drive end 24 can abut against the second fastening edge 13.

Referring to FIG. 7 and FIG. 8, an actuating member 3 can be disposed on a side of the rotating element 4 facing the outlet 10. Referring to FIG. 9, the actuating protrusion 20 of the flap 2 can contact the actuating member 3 of the rotating element 4, as the flap 2 moves from the closed position to the fully open position. The actuating protrusion 20 would press the actuating member 3 to rotate the rotating element 4 away from the sealing position.

Referring to FIG. 8, the actuating member 3 includes an opening section 30, a locking groove 31, and a sloped section 32. The opening section 30 can be a protrusion extending towards the outlet 10. The locking groove 31 can be a concave groove between the opening section 30 and the sloped section 32. The sloped section 32 can be an inclined surface or structure extending towards the outlet 10. In one embodiment, when the flap 2 is at the closed position, the actuating protrusion 20 can abut an end of the opening section 30. When the flap 2 begins to rotate towards the open or fully open position, the actuating protrusion 20 contacts along the opening section 30. Thereby the flap 2 can be opened by slightly rotating the flap 2. When the flap 2 has a small rotation angle, the flap 2 can also form a certain shielding for the outlet 10. Even if the liquid in the container body 7 is filled with boiling water or other liquid at high temperature, the flap 2 can be slightly rotated and the hot air or steam can be discharged from the open outlet 10. Due to the shielding effect of the flap 2, the hot air or steam will not be directly sprayed to the user's hand.

When the flap 2 is further rotated, the actuating protrusion 20 can enter the locking groove 31, thereby locking the flap 2. If there is no external force, the flap 2 will be maintain at this open position without further deflection. In one embodiment, the flap 2 further includes a locking protrusion 21. In the process of the flap 2 from the closed position to the fully open position, the locking protrusion 21 can contact the actuating member 3 after the actuating protrusion 20. In one embodiment, after the flap 2 further rotates until the actuating protrusion 20 slides out of the locking groove 31 and the sloped section 32, the locking protrusion 21 slides into the locking groove 31. That is, when the actuating protrusion 20 is about to break contact with the actuating member 3, the locking protrusion 21 begins contact with the actuating member 3. The flap 2 will not reverse if there is no external force. After that, the locking projection 21 contacts the opening section 30, the locking groove 31, and the sloped section 32 of the actuating member 3, to drive the rotating element 4 to rotate about the rotating shaft 40.

When the flap 2 rotates to the fully open position, the locking protrusion 21 is received in the locking groove 31. That is, the flap 2 can be maintained at the fully open position by a clamping force between the locking protrusion 21 and the locking groove 31. When the user drinks the liquid in the container, it is not necessary for the user to physically hold the flap 2.

The actuating member 3, the actuating protrusion 20 and the locking protrusion 21 can form a similar expansion cam mechanism. The resetting member 6 can keep the actuating protrusion 20 and/or the locking protrusion 21 in contact with the surface of the actuating member 3, thereby the actuating protrusion 20 and/or the locking protrusion 21 biases the rotating member 4 away from the rotating shaft 40. That is, the contact between the actuating protrusion 20 or the locking protrusion 21 and the actuating member 3 will cause the rotating element 4 to move with movement of the flap 2. The flap 2 can be further pulled by an external force and turned away by a large angle to facilitate the cleaning of the lid.

The actuating member 3 can be integrally formed with the rotating element 4. Alternatively, the actuating member 3 and the rotating element 4 can also be assembled and fixed by separate processing such as bonding and snapping.

The description above is merely exemplary embodiments of the present disclosure, but is not intended to limit the disclosure. Any modifications, substitutions, or improvements made without departing from the spirits and scope of the disclosure shall all fall within the protection of the disclosure.

What is claimed is:

1. A flip lid comprising a lid body, the lid body defining an outlet through the lid body, a flap rotatably connected to a first side of the lid body, a rotating element rotatably connected to a second side of the lid body, the rotating element being movable between a sealing position and an unsealing position, a resetting member biasing the rotating element to the sealing position, an actuating member disposed on a side of the rotating element facing the outlet, wherein the outlet forms a seal with the rotating element in the sealed position, the seal between the rotating element and the outlet is broken in the unsealed position, the rotating element covers the outlet in the sealing position, and the flap comprises an actuating protrusion configured to push the actuating member away from the sealing position to the unsealing position when the flap is rotated from a closed position towards an open position;

the lid body comprises a concave groove, the resetting member is a torsion spring, one end of the torsion spring is fastened to the rotating element, and the other end of the torsion spring is received in the concave groove.

2. The flip lid of claim 1, wherein the actuating member comprises an opening section protruding toward the outlet and a locking groove away from the outlet, when the actuating protrusion contacts the opening section, the rotating element rotates to open the outlet, and when the actuating protrusion enters the locking groove, the flap is locked.

3. The flip lid of claim 2, wherein the flap comprises a locking protrusion, after the flap rotates and is open until the actuating protrusion leaves out of the locking groove, the locking protrusion inserts into the locking groove.

4. The flip lid of claim 2, wherein when the flap is at the closed position, the actuating protrusion abuts against an end of the opening section.

5. The flip lid of claim 3, wherein the lid body comprises a second fastening edge corresponding to the open position of the flap, and when the locking protrusion inserts into the locking groove, the flap abuts against the second fastening edge.

6. The flip lid of claim 1, wherein the actuating member is integrally formed with the rotating element.

7. The flip lid of claim 1, wherein the rotating element comprises a sealing ring attached to the rotating element and configured to seal and surround the outlet.

8. The flip lid of claim 7, wherein a sealing flange is formed on a side of the outlet facing the rotating element, and the sealing ring is pressed against the sealing flange.

9. The flip lid of claim 4, wherein the flap is rotatably connected to the lid body through a pivot shaft, one end of the flap extends beyond an edge of the lid body to form a driving end, and the actuating protrusion and the driving end are respectively located at two sides of the pivoting shaft.

10. The flip lid of claim 9, wherein the lid body further comprises a first fastening edge corresponding to the closed position of the flap, and the first fastening edge comprises a fastening groove and the flap comprises a fastening protrusion coupled to the fastening groove when the flap is at the closed position of the flap.

11. A container comprising the flip lid of claim 1 and a container body.

* * * * *